US010987961B2

(12) United States Patent
Aoyama et al.

(10) Patent No.: US 10,987,961 B2
(45) Date of Patent: Apr. 27, 2021

(54) LIGHT-EMITTING MEDIUM, FORGERY PREVENTION MEDIUM, AND METHOD FOR DETERMINING AUTHENTICITY OF SAME

(71) Applicant: Dai Nippon Printing Co., Ltd., Tokyo (JP)

(72) Inventors: Yuko Aoyama, Tokyo (JP); Jun Sato, Tokyo (JP)

(73) Assignee: Dai Nippon Printing Co., Ltd., Tokyo (JP)

( * ) Notice: Subject to any disclaimer, the term of this patent is extended or adjusted under 35 U.S.C. 154(b) by 0 days.

(21) Appl. No.: 16/493,109

(22) PCT Filed: Mar. 12, 2018

(86) PCT No.: PCT/JP2018/009427
§ 371 (c)(1),
(2) Date: Sep. 11, 2019

(87) PCT Pub. No.: WO2018/168742
PCT Pub. Date: Sep. 20, 2018

(65) Prior Publication Data

US 2020/0079128 A1 Mar. 12, 2020

(30) Foreign Application Priority Data

Mar. 16, 2017 (JP) ..... JP2017-051743

(51) Int. Cl.
*B41M 3/14* (2006.01)
*B42D 25/351* (2014.01)
(Continued)

(52) U.S. Cl.
CPC ..... *B41M 3/144* (2013.01); *B41M 3/06* (2013.01); *B42D 25/351* (2014.10); *B42D 25/387* (2014.10)

(58) Field of Classification Search
CPC ..... B41M 3/14; B41M 3/06; B42D 25/387; B42D 25/351
(Continued)

(56) References Cited

U.S. PATENT DOCUMENTS

2006/0249951 A1* 11/2006 Cruikshank ..... B42D 25/29 283/92
2008/0106002 A1* 5/2008 Feldman ..... B42D 25/00 264/400
2011/0147614 A1 6/2011 Kane et al.

FOREIGN PATENT DOCUMENTS

JP 4418881 B2 2/2010
JP 5681725 B2 3/2015
(Continued)

OTHER PUBLICATIONS

International Search Report dated May 29, 2018, issued for PCT/JP2018/009427.
(Continued)

*Primary Examiner* — Justin V Lewis
(74) *Attorney, Agent, or Firm* — Locke Lord LLP

(57) ABSTRACT

To provide a light-emitting medium whereby different light-emitting forms can be realized that can easily be discriminated using a normal blacklight, and to provide a forgery prevention medium and a method for determining authenticity of the light-emitting medium. A light-emitting medium provided with a substrate and a first light-emitting region and a second light-emitting region disposed on both sides of the substrate, the substrate comprising a selective transmission region for transmitting non-visible light in a first wavelength region and essentially not transmitting non-visible light in a second wavelength region different from the first wavelength region, and the first light-emitting region and the second light-emitting region emitting light when irradiated by non-visible light in the first wavelength region
(Continued)

and also emitting light when irradiated by non-visible light in the second wavelength region.

6 Claims, 13 Drawing Sheets

(51) Int. Cl.

| | |
|---|---|
| ***B42D 25/387*** | (2014.01) |
| ***B41M 3/06*** | (2006.01) |
| ***G07D 7/1205*** | (2016.01) |
| ***B42D 25/382*** | (2014.01) |
| ***B42D 25/45*** | (2014.01) |

(58) Field of Classification Search
USPC ..... 283/67, 70, 72, 74, 75, 94, 98, 109, 110, 283/901
See application file for complete search history.

(56) References Cited

FOREIGN PATENT DOCUMENTS

| | | | |
|---|---|---|---|
| JP | 2016-091121 | A | 5/2016 |
| WO | 2011/084401 | A2 | 7/2011 |
| WO | 2013/020984 | A1 | 2/2013 |

OTHER PUBLICATIONS

Extended European Search Report dated Oct. 8, 2020, issued in the EP Patent Application No. 18766825.6.

* cited by examiner

LIGHT-EMITTING MEDIUM, FORGERY PREVENTION MEDIUM, AND METHOD FOR DETERMINING AUTHENTICITY OF SAME

TECHNICAL FIELD

The present invention relates to a light-emitting medium including a substrate and a light-emitting region, a forgery prevention medium, and a method for determining authenticity of the light-emitting medium.

BACKGROUND ART

In media including securities such as an exchange ticket for money and a prepaid card, and identification cards such as a license which are necessary to prevent forgery, recently, micro characters, a copy prevention pattern, an infrared absorption ink, a fluorescent ink, or the like has been used to enhance security properties. Among these, the fluorescent ink is an ink containing a fluorescent substance that is not substantially visually recognized under visible light, and is visually recognized when being irradiated with non-visible light (ultraviolet rays or infrared rays). When using such fluorescent ink, it is possible to form a fluorescent image (light-emitting image), which appears only when the securities and the like are irradiated with non-visible light in a specific wavelength region, in the securities and the like. According to this, it is possible to prevent the securities from being easily forged with a general-purpose color printer or the like.

Recently, articles including a forgery prevention countermeasure as described above mainly include various transparent media containing a polymer compound such as plastic. For example, instead of paper, transparent plastic currency, a transparent card, and the like can be exemplified. For example, a plastic substrate that emits visually transparent fluorescence by adjusting a refractive index is disclosed (Patent Document 1).

In addition, to further enhance a forgery prevention effect, there is suggested a configuration in which a light-emitting image that is not visually recognized in accordance with naked eyes is formed in the securities by using a fluorescent ink. For example, Patent Document 2 discloses a medium including a light-emitting image that is formed by using a first fluorescent ink and a second fluorescent ink. In this case, the first fluorescent ink and the second fluorescent ink are inks which are visually recognized as the same color under visible light and ultraviolet ray when being viewed with naked eyes, and are visually recognized as different colors when being viewed through a discrimination tool. According to this, it is difficult for the light-emitting image formed on the securities to be easily forged, and as a result, the forgery prevention effect due to the fluorescent inks is enhanced.

However, it is preferable to simply and rapidly carry out a procedure of discriminating whether or not the securities are forged. Accordingly, there is a demand for a medium with which discrimination as to whether or not the securities are forged can be easily and rapidly made by using normal blacklight without using an additional discrimination tool.

Patent Document 1: Japanese Patent No. 5681725

Patent Document 2: Japanese Patent No. 4418881

DISCLOSURE OF THE INVENTION

Problems to be Solved by the Invention

However, according to the technology disclosed in Patent Document 2, it is necessary to prepare two kinds of tools including blacklight and a discrimination tool. Therefore, there is a demand for a medium capable of more easily realizing different light-emitting forms capable of being easily discriminated by using normal black light. In addition, the medium may also be used for purposes other than forgery prevention (authenticity determination).

An object of the invention is to provide a light-emitting medium capable of realizing different light-emitting forms capable of being easily discriminated by using normal blacklight, a forgery prevention medium, and a method for determining authenticity of the light-emitting medium.

Means for Solving the Problems

The invention accomplishes the object by the following means for solving the problems. Note that, description will be made by applying reference numerals corresponding to an embodiment of the invention for easy understanding, but there is no limitation thereto.

According to a first aspect of the invention, there is provided a light-emitting medium (1, 1A) including a substrate (2), and a first light-emitting region (3) and a second light-emitting region (4) disposed on both sides of the substrate (2). The substrate (2) includes a selective transmission layer through which non-visible light in a first wavelength region is transmitted, and non-visible light in a second wavelength region different from the first wavelength region is not substantially transmitted, and the first light-emitting region (3) and the second light-emitting region (4) contain a fluorescent substance that emits light when being irradiated with non-visible light in the first wavelength region and also emits light when being irradiated with non-visible light in the second wavelength region.

According to a second aspect of the invention, in the light-emitting medium according to the first aspect, the first light-emitting region (3) and the second light-emitting region (4) have shapes which at least partially do not overlap each other when viewed in a thickness direction (Z) of the substrate (2) through the substrate (2).

According to a third aspect of the invention, in the light-emitting medium according to the first or second aspect, the fluorescent substance of the first light-emitting region (3) and the fluorescent substance of the second light-emitting region (4) emit light which are visually recognized as different colors when being irradiated with non-visible light in the first wavelength region, and emit light which are visually recognized as different colors even when being irradiated with non-visible light in the second wavelength region.

According to a fourth aspect of the invention, in the light-emitting medium according to any one of the first to third aspects, the first light-emitting region (3A) and the second light-emitting region (4A) show an incomplete shape only on one side, and in a state in which both the fluorescent substance of the first light-emitting region (3A) and the fluorescent substance of the second light-emitting region (4A) emit light, the first light-emitting region (3A) and the second light-emitting region (4A) show a complete shape on both sides.

According to a fifth aspect of the invention, there is provided a forgery prevention medium to which the light-emitting medium according to any one of the first to fourth aspects is applied.

According to a sixth aspect of the invention, there is provided a method for determining authenticity of the light-emitting medium according to any one of the first to fourth aspects. The method includes: a preparation process of preparing a light-emitting medium (1, 1A); a first wavelength irradiation process of irradiating the light-emitting medium (1, 1A) with non-visible light in a first wavelength region to confirm light-emission of both of the fluorescent substance of the first light-emitting region (3) and the fluorescent substance of the second light-emitting region (4); a second wavelength irradiation process of irradiating the light-emitting medium (1, 1A) with non-visible light in a second wavelength region to confirm light-emission of only one on an irradiation source side between the fluorescent substance of the first light-emitting region (3) and the fluorescent substance of the second light-emitting region (4); and a determination process of determining that the light-emitting medium (1, 1A) is genuine when confirmation is obtained in both the first wavelength irradiation process and the second wavelength irradiation process.

Effects of the Invention

According to the invention, it is possible to provide a light-emitting medium capable of realizing different light-emitting forms capable of being easily discriminated by using normal blacklight, a forgery prevention medium, and a method for confirming the light-emitting medium.

PREFERRED MODE FOR CARRYING OUT THE INVENTION

Embodiments

Hereinafter, embodiments of the invention will be described with the drawings and the like. The embodiments relate to a case where a light-emitting medium of the invention is applied to a forgery prevention medium. Here, examples of the forgery prevention medium include a cash card that is used in a bank or the like, a membership card that is used in a shop or the like, plastic paper money (resin sheet paper money), a data page of passport, and the like. Note that, for example, when being used as a cash card or a membership card, the forgery prevention medium may be provided with an IC chip or a communication antenna that is used in individual authentication or the like, or may be provided with a printed layer that applies a pattern or the like to front and rear surfaces of the card, functional layers, and the like in addition to the configuration illustrated in FIG. 1 to be described later. In addition, even in the case of being used as paper money, the forgery prevention medium may be further provided with a forgery prevention configuration such as a water mark provided in typical paper money or the like.

First Embodiment

Figure 1:
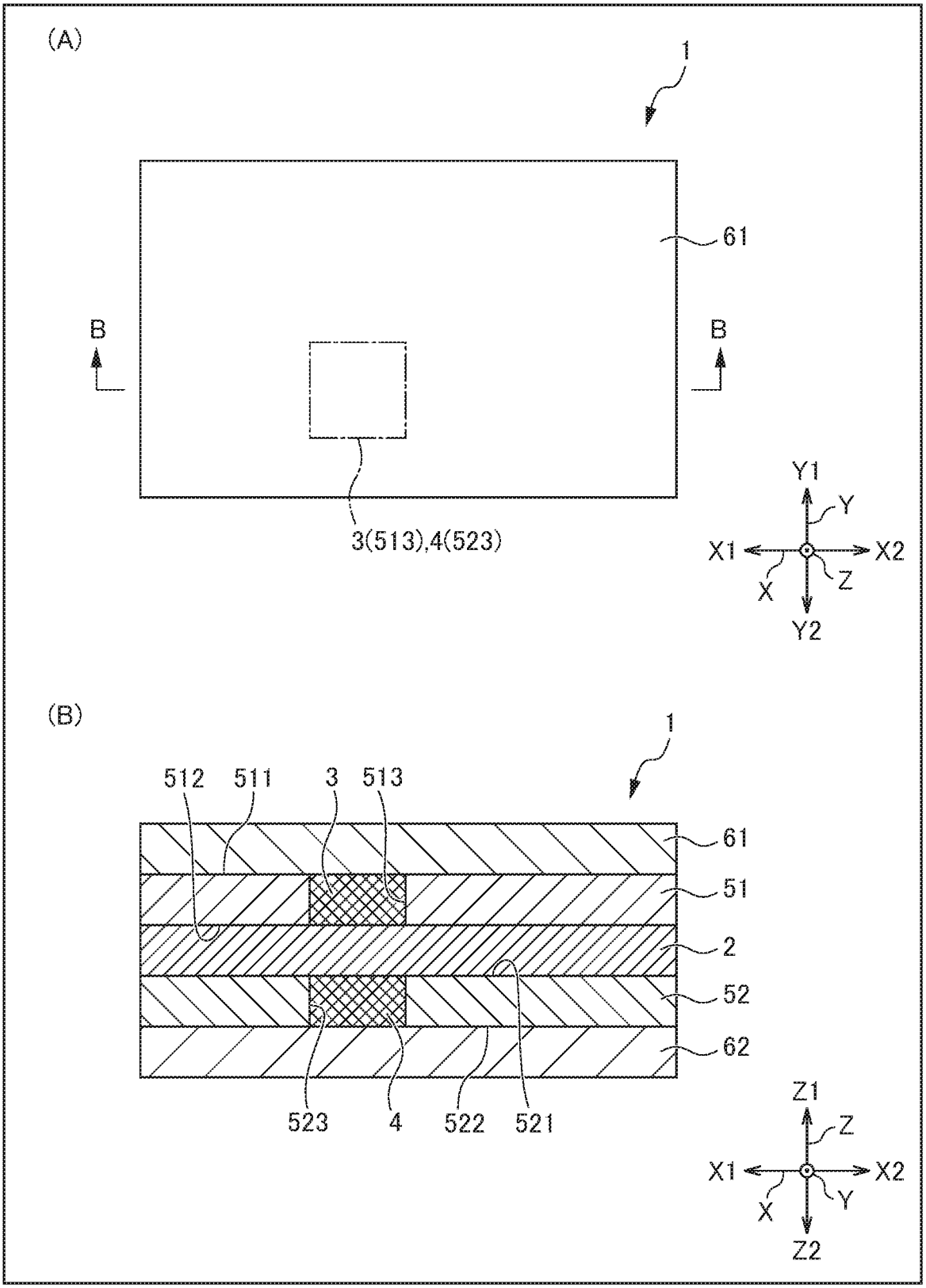
FIG. 1 is a view illustrating a forgery prevention medium 1 of a first embodiment as a light-emitting medium of the invention, and in FIG. 1, (A) is a plan view, and (B) is a cross-sectional view taken along line B-B in (A).
Figure 2:
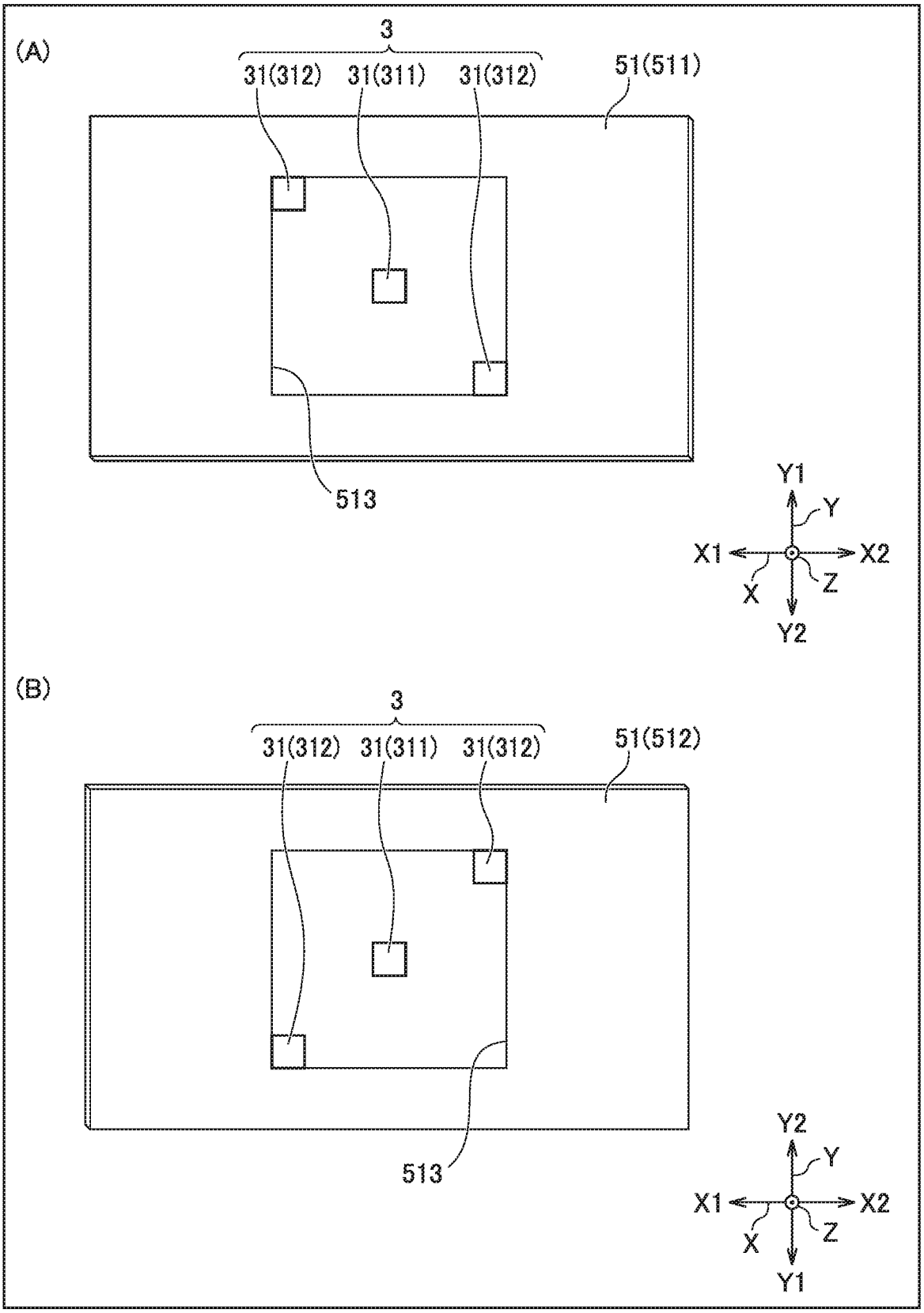
FIG. 2 is a view illustrating a first printed layer 51 including a first light-emitting region 3 in the forgery prevention medium 1 of the first embodiment by virtually extracting the first printed layer 51, and in FIG. 2, (A) is a plan view, and (B) is a rear view.
Figure 3:
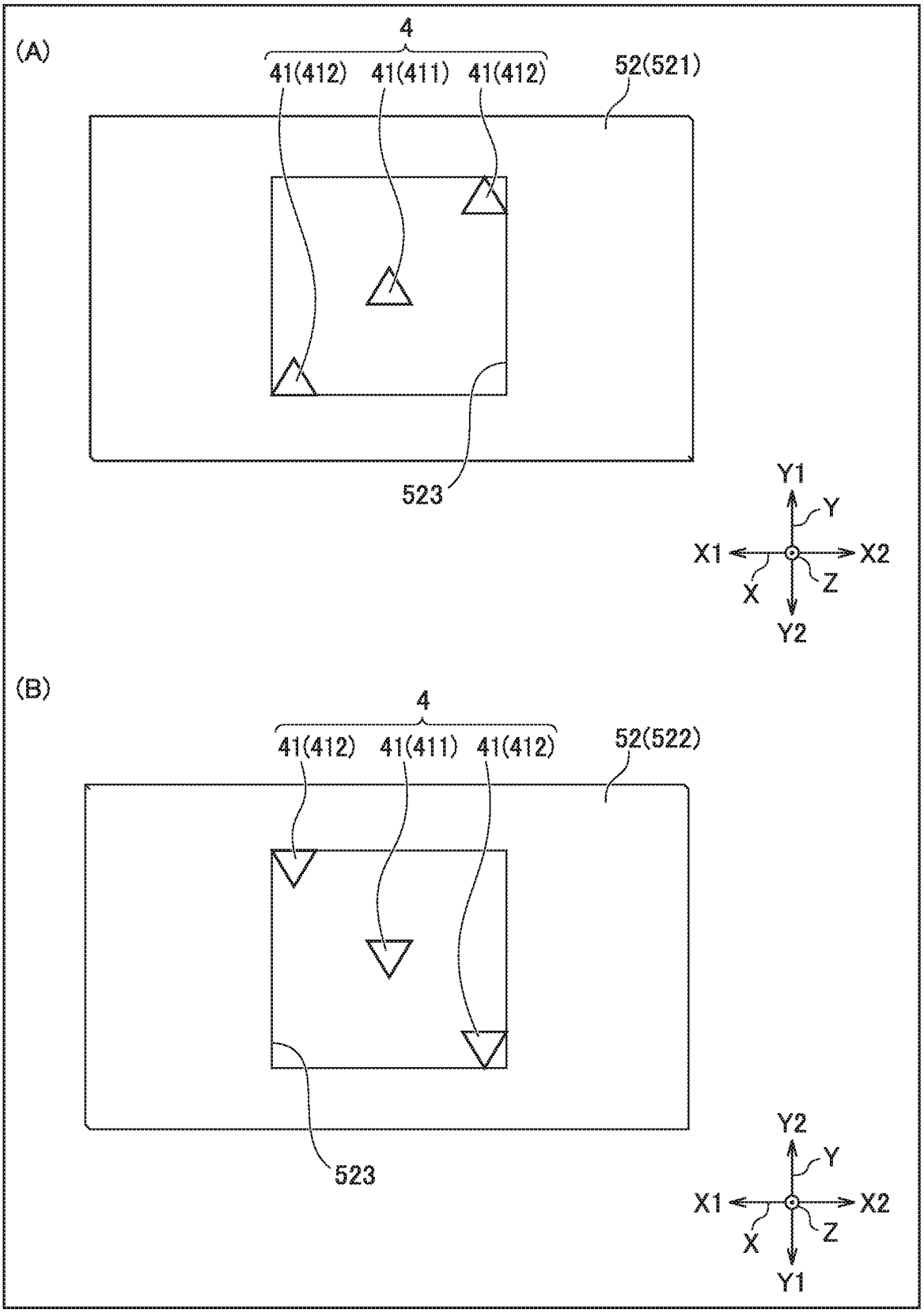
FIG. 3 is a view illustrating a second printed layer 52 including a second light-emitting region 4 in the forgery prevention medium 1 of the first embodiment by virtually extracting the second printed layer 52, and in FIG. 3, (A) is a plan view, and (B) is a rear view.
Figure 4:
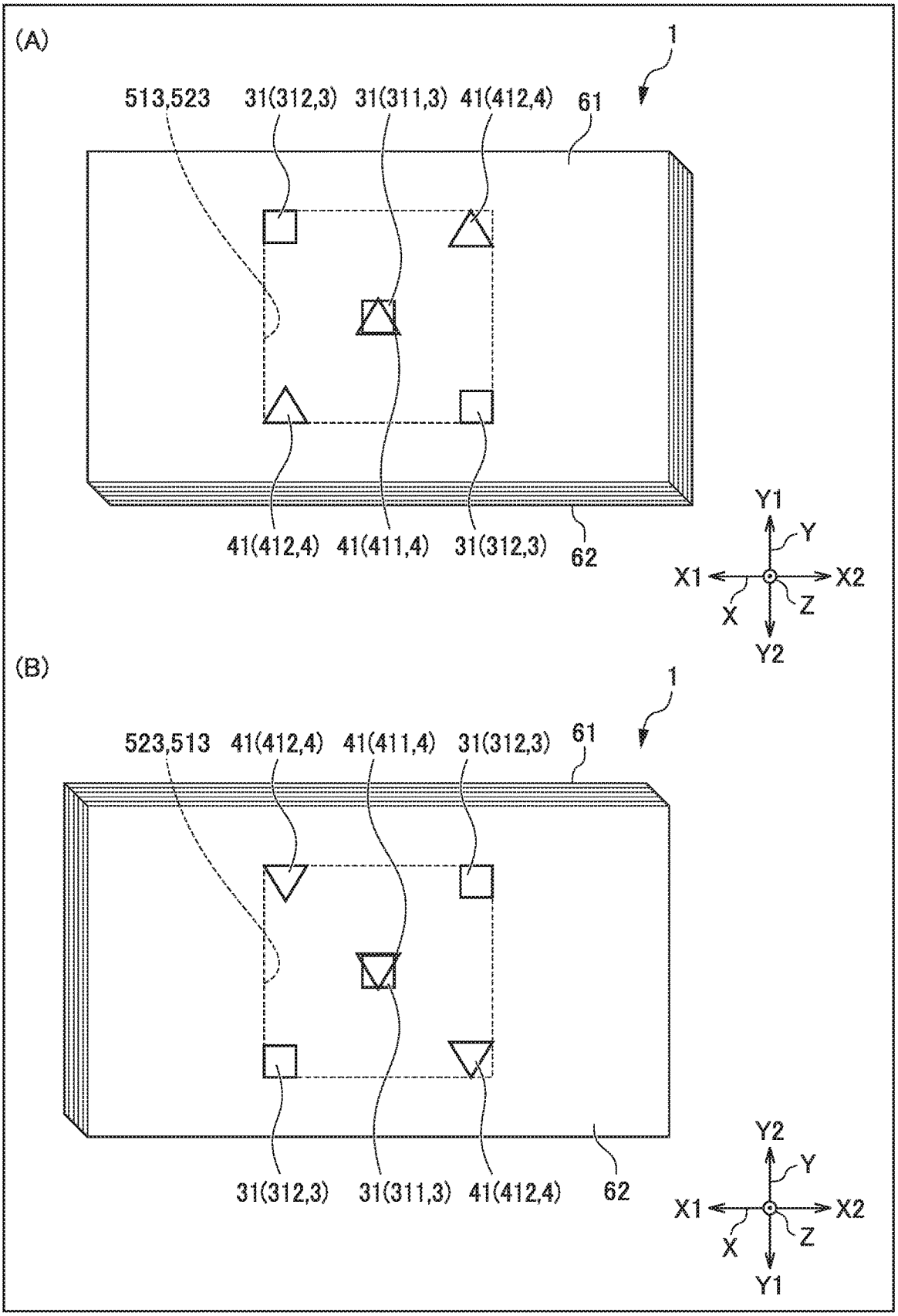
FIG. 4 is a view illustrating a light-emitting form when the forgery prevention medium 1 of the first embodiment is irradiated with non-visible light in a first wavelength region, and in FIG. 4, (A) is a plan view, and (B) is a rear view.
Figure 5:
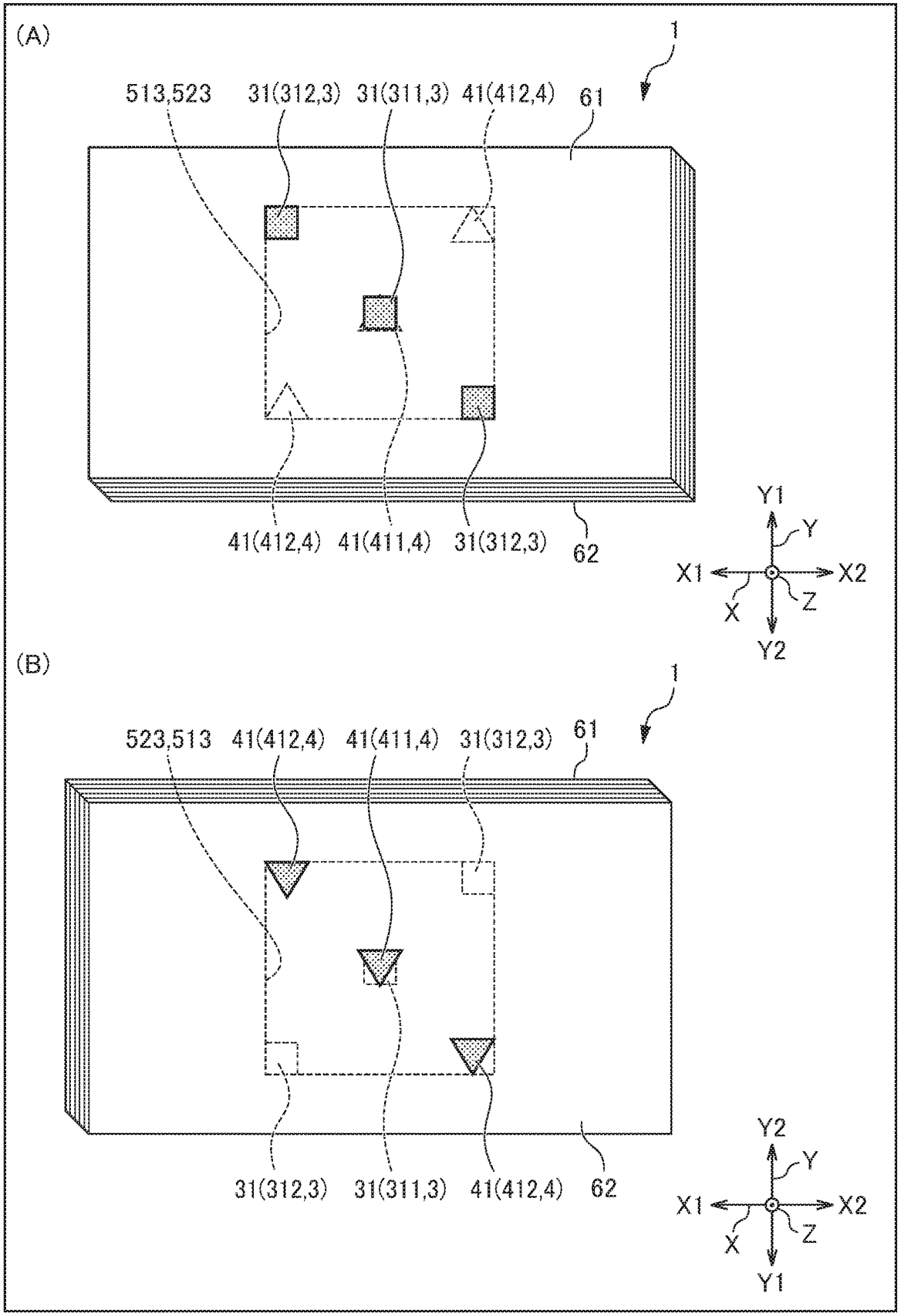
FIG. 5 is a view illustrating a light-emitting form when the forgery prevention medium 1 of the first embodiment is irradiated with non-visible light in a second wavelength region, and in FIG. 5, (A) is a plan view, and (B) is a rear view.

FIG. 1 is a view illustrating a forgery prevention medium 1 of a first embodiment as a light-emitting medium of the invention, and in FIG. 1, (A) is a plan view and (B) is a cross-sectional view taken along line B-B in (A). FIG. 2 is a view illustrating a first printed layer 51 including a first light-emitting region 3 in the forgery prevention medium 1 of the first embodiment by virtually extracting the first printed layer 51, and in FIG. 2, (A) is a plan view, and (B) is a rear view. FIG. 3 is a view illustrating a second printed layer 52 including a second light-emitting region 4 in the forgery prevention medium 1 of the first embodiment by virtually extracting the second printed layer 52, and in FIG. 3, (A) is a plan view, and (B) is a rear view. FIG. 4 is a view illustrating a light-emitting form when the forgery prevention medium 1 of the first embodiment is irradiated with non-visible light in a first wavelength region, and in FIG. 4, (A) is a plan view, and (B) is a rear view. FIG. 5 is a view illustrating a light-emitting form when the forgery prevention medium 1 of the first embodiment is irradiated with non-visible light in a second wavelength region, and in FIG. 5, (A) is a plan view, and (B) is a rear view.

In the embodiment and the drawings, an XYZ orthogonal coordinate system is provided for easy explanation and easy understanding. The coordinate system shows a right and left direction X (a left side: X1, and a right side: X2), a vertical direction Y (an upper side: Y1, and a lower side: Y2), and a thickness direction Z (a front (upper) side: Z1, and a rear (lower) side: Z2) on the basis of a state of FIG. 1. A shape is appropriately simplified or deformed in accordance with the drawings. For example, in FIG. 1, shapes of the first light-emitting region 3 and the second light-emitting region 4 are simplified, and the first light-emitting region 3 and the second light-emitting region 4 are illustrated in a rectangular shape. In FIGS. 2 to 5, sizes of the first light-emitting region 3 and the second light-emitting region 4 are deformed, and the shapes of the first light-emitting region 3 and the second light-emitting region 4 are enlarged.

Layer Structure

As illustrated in FIGS. 1 to 3, the forgery prevention medium 1 is a sheet-shaped article having a rectangular shape in an XY plane, and is a laminated body in which a first transparent protective layer 61, the first printed layer 51 including the first light-emitting region 3, a substrate layer 2, the second printed layer 52 including the second light-emitting region 4, and a second transparent protective layer 62 are laminated in this order from the front side Z1 to the rear side Z2 in the thickness direction Z. Note that, when making a common description, the "first transparent protective layer 61" and the "second transparent protective layer 62" may be simply referred to as "transparent protective layer". Similarly, when making a common description, the "first light-emitting region 3" and the "second light-emitting region 4" may be simply referred to as "light-emitting region". When making a common description, the "first printed layer 51" and the "second printed layer 52" may be referred to as "printed layer".

The substrate layer 2 is a layer that becomes a substrate of the forgery prevention medium 1, and may be referred to as "substrate 2" in this specification. For example, as the substrate layer 2, transparent polypropylene (PP), polyethylene terephthalate (PET), polycarbonate (PC), or the like with excellent printability and processability is used. Here, "transparent" represents that visible light is transmitted. A selective transmission property of the substrate layer 2 as one characteristic of the invention will be described later in detail. Note that, typically, the substrate layer 2 is a layer having the highest rigidity, but a layer having further higher rigidity or a layer having a larger thickness may exist in the forgery prevention medium (light-emitting medium) 1 in addition to the substrate layer 2.

The first printed layer 51 is formed on an upper surface of the substrate layer 2 through printing. A lower surface 512 of the first printed layer 51 is in contact with the upper surface of the substrate layer 2. The second printed layer 52 is formed on a lower surface of the substrate layer 2 through printing. An upper surface 521 of the second printed layer 52 is in contact with the lower surface of the substrate layer 2. Examples of the printing include silk screen printing, offset, gravure printing, and the like. It is preferable that an ink of the first printed layer 51 (excluding the first light-emitting region 3) and the second printed layer 52 (excluding the second light-emitting region 4) has a high light-shielding property of not allowing light to be transmitted therethrough (for example, an ink having a high shielding property at a white color).

As illustrated in FIG. 2, a partial region of an XY plane in the first printed layer 51 is set to a first window portion 513 that passes through the first printed layer 51 in a thickness direction Z. As illustrated in FIG. 3, a partial region of an XY plane in the second printed layer 52 is set to a second window portion 523 that passes through the second printed layer 52 in the thickness direction Z. In a case where an attention is paid only to the first printed layer 51, when the first printed layer 51 is seen from the thickness direction Z, the region of the first window portion 513 is observed transparently. This is also true of the second printed layer 52. When making a common description, the "first window portion 513" and the "second window portion 523" may be referred to as "window portion". In addition, when viewed in the thickness direction Z, an external shape of the first window portion 513 and an external shape of the second window portion 523 equal and match each other. Note that, an external shape of one side of the first window portion 513 and the second window portion 523 may be set to be larger than an external shape of the other side without limitation to the above-described mode. Note that, since the window portion provided in each of the printed layers is a region in which printing is not performed to a part of the printed layer, that is, a region through which incident light can be transmitted, in accordance with an application mode of the forgery prevention medium 1, the window portion may be filled with a transparent material of a polycarbonate resin or the like, or a transparent member of the same resin or the like (polycarbonate resin or the like) may be disposed in the window portion (an application mode of the forgery prevention medium 1 will be described later).

The first light-emitting region 3 is provided in the first window portion 513. The second light-emitting region 4 is provided in the second window portion 523. The first light-emitting region 3 and the second light-emitting region 4 are formed by printing (for example, offset) or applying an ink containing a fluorescent substance to at least a part of a position corresponding to the window portion of the substrate layer 2. The first light-emitting region 3 and the second light-emitting region 4 have transparency when light is not emitted. In addition, the first light-emitting region 3 and the second light-emitting region 4 contain a fluorescent substance that emits visible light when being irradiated with non-visible light in a first wavelength region, and emits visible light even when being irradiated with non-visible light in a second wavelength region. Details of the fluorescent substance contained in the light-emitting region will be described later. Note that, the first light-emitting region 3 and the second light-emitting region 4 may be formed after printing the first printed layer 51 and the second printed layer 52 on the substrate layer 2, or after forming the first light-emitting region 3 and the second light-emitting region 4 on the substrate layer 2, the first printed layer 51 and the second printed layer 52 may be subsequently printed.

The transparent protective layer is a layer called an overcoat layer, and is a transparent layer through which various kinds of light are transmitted. A known transparent material can be used as the transparent protective layer, and the transparent protective layer is formed, for example, by a polycarbonate resin, an acrylic resin, a polyethylene terephthalate resin, or the like. The first transparent protective layer 61 is a layer that is provided on an upper surface 511 of the first printed layer 51 to protect the first printed layer 51. The second transparent protective layer 62 is a layer that is provided on a lower surface 522 of the second printed layer 52 to protect the second printed layer 52.

Fluorescent Substance Contained in Light-Emitting Region

The fluorescent substance contained in the light-emitting region is not particularly limited as long as the fluorescent substance absorbs an electromagnetic wave having a specific wavelength in a wavelength region of an ultraviolet ray region or an infrared ray region and emits light. Examples of the fluorescent substance include an ultraviolet ray absorbing fluorescent substance and an infrared ray absorbing fluorescent substance. An ultraviolet ray represents an electromagnetic wave having a wavelength of less than 400 nm. In addition, the ultraviolet ray region represents a wavelength region of less than 400 nm. Visible light represents an electromagnetic wave (light) having a wavelength in a wavelength range of 400 nm to 700 nm. In addition, a visible light region represents a wavelength region of 400 nm to 700 nm. An infrared ray represents an electromagnetic wave having a wavelength of greater than 700 nm. In addition, the infrared ray region represents a wavelength region of greater than 700 nm.

The ultraviolet ray absorbing fluorescent substance is a fluorescent substance that absorbs an ultraviolet ray, and in the invention, a fluorescent substance that absorbs an ultraviolet ray and emits visible light is used. Examples of the ultraviolet ray absorbing fluorescent substance that absorbs an ultraviolet ray and emits visible light include a fluorescent substance that absorbs UV-A (in a wavelength range of 315 nm to 380 nm) and emits visible light, a fluorescent substance that absorbs UV-B (in a wavelength range of 280 nm to 315 nm) and emits visible light, a fluorescent substance that absorbs UV-C (in a wavelength range of 200 nm to 280 nm) and emits visible light, and the like. Note that, visible light that is emitted from the fluorescent substance can be appropriately selected in correspondence with the kind of the fluorescent substance.

As the ultraviolet ray absorbing fluorescent substance, a known fluorescent substance can be exemplified, and specific examples thereof include an ultraviolet-excited and visible light emitting type fluorescent substance described in Japanese Unexamined Patent Application Publication No. 2012-011550, a dichromatic fluorescent substance described in Japanese Patent No. 5573469, and the like. In the case of using the dichromatic fluorescent substance, for example, it is possible to allow visible light (for example, a green light and a red light) having different wavelengths to be emitted by using ultraviolet rays of two different wavelengths.

The infrared ray absorbing fluorescent substance is a fluorescent substance that absorbs an infrared ray, and in the invention, a fluorescent substance that absorbs an infrared ray and emits visible light is used. Examples of the infrared ray absorbing fluorescent substance that absorbs an infrared ray and emits visible light include a fluorescent substance that is called an up-conversion material, absorbs a near infrared light of 800 nm, and emits green visible light near 530 nm, and the like. An excitation wavelength is appropriately selected in accordance with a fluorescent substance, and can be appropriately selected in correspondence with a kind of the fluorescent substance with respect to visible light that is emitted from the fluorescent substance.

As the infrared ray absorbing fluorescent substance, a known fluorescent substance can be exemplified, and specific examples thereof include an infrared-excited and visible light emitting type fluorescent substance described in Japanese Unexamined Patent Application Publication No. 2012-011550, and a fluorescent substance containing an up-conversion rare earth element described in Japanese Patent No. 4276864 or Japanese Patent No. 4498825.

In the invention, a plurality of kinds of fluorescent substances may be used. In addition, in the case or the like of forming the light-emitting regions in a pattern shape, the kinds of fluorescent substances contained in patterns of each of the light-emitting regions may be made different.

Selective Transmission Property of Substrate Layer

The substrate layer 2 is constituted by a selective transmission layer through which non-visible light in a first wavelength region is transmitted and non-visible light in a second wavelength region different from the first wavelength region is not substantially transmitted. For example, non-visible light in the first wavelength region is an ultraviolet ray (non-visible light) so-called UV-A in a wavelength region less than 315 to 400 nm. Non-visible light in the second wavelength region is an ultraviolet ray (non-visible light) so-called UV-C in a wavelength region of 200 to 280 nm. Note that, "substantially not transmitted" represents that light is not transmitted to a certain extent capable of obtaining the effect of the invention, and light may be transmitted to a certain extent in a range not deteriorating the effect of the invention in the opposite viewpoint. As a form of "not transmitted", "absorbs" and/or "reflects" are exemplified.

The first light-emitting region 3 and the second light-emitting region 4 have shapes which at least partially do not overlap each other when viewed through the substrate layer 2 in the thickness direction Z of the substrate layer 2. Specifically, as illustrated in FIG. 2, the first light-emitting region 3 includes three rectangular first light-emitting elements 31 which are linearly arranged. As illustrated in FIG. 3, the second light-emitting region 4 includes three triangular second light-emitting elements 41 which are linearly arranged. When viewed through the substrate layer 2 in the thickness direction Z of the substrate layer 2, as illustrated in FIG. 4, a central first light-emitting element 311 located at the center among the three first light-emitting elements 31, and a central second light-emitting element 411 located at the center among the three second light-emitting elements 41 partially overlap each other. On the other hand, non-central first light-emitting elements 312 located at a position other than the center among the three first light-emitting elements 31 and non-central second light-emitting elements 412 located at a position other than the center among the three second light-emitting elements 41 do not overlap each other. The linear arrangement shape of the first light-emitting elements 31 and the linear arrangement shape of the second light-emitting elements 41 intersect each other in an X-shape. In addition, in another viewpoint, the first light-emitting elements 31 and the second light-emitting elements 41 are arranged similarly to "5" of dice and emit light.

Different-Color Light-Emission

Description will be given of different-color light-emission as a first coloring form. The fluorescent substance of the first light-emitting region 3 and the fluorescent substance of the second light-emitting region 4 emit light of colors visually recognized as different colors when being irradiated with non-visible light in the first wavelength region, and emit light of colors visually recognized as different colors even when being irradiated with non-visible light in the second wavelength region. For example, when being irradiated with non-visible light in the first wavelength region or when being irradiated with non-visible light in the second wavelength region, the fluorescent substance of the first light-emitting region 3 emits green light, and the fluorescent substance of the second light-emitting region 4 emits red light.

In a range in which the first light-emitting region 3 and the second light-emitting region 4 overlap each other, light of a color visually recognized as a further different color is emitted. For example, in the case of being irradiated with non-visible light in the first wavelength region, in a range in which the central first light-emitting element 311 and the central second light-emitting element 411 overlap each other, yellow light that is shown by additive color mixture of green light and red light is emitted.

Same-Color Light-Emission

Description will be given of same-color light-emission as a second coloring form. The fluorescent substance of the first light-emitting region 3 and the fluorescent substance of the second light-emitting region 4 emit light of a color visually recognized as the same color when being irradiated with non-visible light in the first wavelength region, and emit light of color visually recognized as the same color when being irradiated with non-visible light in the second wavelength region. Here, the color in irradiation with non-visible light in the first wavelength region and the color in irradiation with non-visible light in the second wavelength region may be different from each other or may not be different from each other. In a case where the colors are not different from each other (in the case of the same color), only a light-emission shape is changed.

For example, when being irradiated with non-visible light in the first wavelength region, the fluorescent substance of the first light-emitting region 3 and the fluorescent substance of the second light-emitting region 4 emit green light as the same color. When being irradiated with non-visible light in the second wavelength region, the fluorescent substance of the first light-emitting region 3 and the fluorescent substance of the second light-emitting region 4 emit red light as the same color. Here, the color (green) in irradiation with non-visible light in the first wavelength region, and the color (red) in irradiation with non-visible light in the second wavelength region may be different from each other, or may not be different from each other. In a case where colors are not different from each other (in the case of the same color), only a light-emission shape is changed.

In the invention, the "same color" represents that chromaticities of the two colors are close to each other to a certain extent in which a color difference is not discriminated with naked eyes. More specifically, the "same color" represents that a color difference $\Delta E^*_{ab}$ between the two colors is 10 or less, and preferably 3 or less. In addition, the "different color" represents that a color difference $\Delta E^*_{ab}$ between the two colors is 10 or greater. Here, the color difference $\Delta E^*_{ab}$ is a value that is calculated on the basis of L*, a*, and b* in an L*a*b* color system, and is a value that becomes an index relating to a difference of colors in the case of being observed with naked eyes. Note that, L*, a*, and b* in the L*a*b* color system or tristimulus values X, Y, and Z in an XYZ color system are calculated on the basis of a spectrum of light, or the like. In addition, a relationship according to a known conversion expression is established between the L*, a*, and b*, and the tristimulus values X, Y, and Z. The above-described tristimulus values and the color difference $\Delta E^*_{ab}$ are calculated by a method described, for example, in Japanese Patent No. 5573469.

Light-Emitting Form in Irradiation with Non-Visible Light in First Wavelength Region Description will be given of a light-emitting form in irradiation with non-visible light in the first wavelength region. At the time of irradiation with non-visible light in the first wavelength region, non-visible light in the first wavelength region is transmitted through the transparent protective layer and the window portion, and is transmitted through the substrate layer 2. Accordingly, when being irradiated with non-visible light in the first wavelength region, a light-emitting region located on an irradiation source side emits light, and a light-emitting region located on a side opposite to the irradiation source with the substrate layer 2 interposed therebetween also emits light. That is, as illustrated in FIG. 4, both the first light-emitting region 3 and the second light-emitting region 4 emit light. Note that, in FIG. 4, the first light-emitting region 3 and the second light-emitting region 4 do not exist in an outermost layer, but are indicated by a solid line for convenience. In a range in which the central first light-emitting element 311 and the central second light-emitting element 411 overlap each other, yellow light is emitted. In only the first light-emitting elements 31, green light is emitted. In only the second light-emitting elements 41, red light is emitted. As described above, a total of six first light-emitting elements 31 and second light-emitting elements 41 emit light. Note that, the central first light-emitting element 311 and the central second light-emitting element 411 among six elements integrally emit light in a state of partially overlapping each other.

Light-Emitting Form in Irradiation with Non-Visible Light in Second Wavelength Region Description will be given of a light-emitting form in irradiation with non-visible light in the second wavelength region. At the time of irradiation with non-visible light in the second wavelength region, non-visible light in the second wavelength region is transmitted through the transparent protective layer and the window portion, but is not transmitted through the substrate layer 2. Accordingly, when being irradiated with non-visible light in the second wavelength region, a light-emitting region located on an irradiation source side emits light, but a light-emitting region located on a side opposite to the irradiation source with the substrate layer 2 interposed therebetween does not emit light. That is, as illustrated in FIG. 5(A), when being irradiated with non-visible light in the second wavelength region from the first light-emitting region 3 (first transparent protective layer 61) side, the first light-emitting region 3 emits light, but the second light-emitting region 4 located on an opposite side with the substrate layer 2 interposed therebetween does not emit light. Note that, in FIG. 5(A), the first light-emitting region 3 does not exist in an outermost layer, but is indicated by a solid line for convenience, and light-emission is indicated by dot hatching.

Similarly, as illustrated in FIG. 5(B), when being irradiated with non-visible light in the second wavelength region from the second light-emitting region 4 (second transparent protective layer 62) side, the second light-emitting region 4 emits light, but the first light-emitting region 3 located on an opposite side with the substrate layer 2 interposed therebetween does not emit light. Note that, in FIG. 5(B), the second light-emitting region 4 does not exist in an outermost layer, but is indicated by a solid line for convenience, and light-emission is indicated by dot hatching.

Method for Determining Authenticity

Next, description will be given of a method for determining authenticity of the forgery prevention medium 1 of the first embodiment as an example of a method for determining authenticity of the invention. First, in a preparation process, the forgery prevention medium 1 is prepared. Next, in a first wavelength irradiation process, the forgery prevention medium 1 is irradiated with non-visible light in the first wavelength region, and confirms that both the fluorescent substance of the first light-emitting region 3 and the fluorescent substance of the second light-emitting region 4 emit light. Next, in a second wavelength irradiation process, the forgery prevention medium 1 is irradiated with non-visible light in the second wavelength region, and confirms that only one on an irradiation source side between the fluorescent substance of the first light-emitting region 3 and the fluorescent substance of the second light-emitting region 4 emits light. In addition, in a determination process, as in a case where confirmation is obtained in both the first wavelength irradiation process and the second wavelength irradiation process, it is determined that the forgery prevention medium 1 is genuine. Note that, the first wavelength irradiation process and the second wavelength irradiation process may be performed in a reverse order.

Effect of First Embodiment

According to the forgery prevention medium 1 of the first embodiment, for example, the following effect is obtained. The forgery prevention medium 1 of the first embodiment includes the substrate 2, and the first light-emitting region 3 and the second light-emitting region 4 which are respectively disposed on both sides of the substrate 2. The substrate 2 is constituted by a selective transmission layer through which non-visible light in the first wavelength region is transmitted, and non-visible light in the second wavelength region different from the first wavelength region is not substantially transmitted. The first light-emitting region 3 and the second light-emitting region 4 contain a fluorescent substance that emits light when being irradiated with non-visible light in the first wavelength region, and emits light even when being irradiated with non-visible light in the second wavelength region.

Accordingly, light-emitting forms are different between irradiation with non-visible light in the first wavelength region (refer to FIG. 4) and irradiation with non-visible light in the second wavelength region (refer to FIG. 5). Accordingly, different light-emitting forms capable of being easily discriminated by using normal blacklight can be realized. Accordingly, for example, it is possible to easily determine authenticity of the forgery prevention medium 1 with naked eyes.

In addition, in the forgery prevention medium 1 of the first embodiment, the first light-emitting region 3 and the second light-emitting region 4 have shapes which at least partially do not overlap each other when viewed in the thickness direction Z of the substrate 2 through the substrate 2. For example, even in a configuration in which the fluorescent substance of the first light-emitting region 3 and the fluorescent substance of the second light-emitting region 4 emit light of a color visually recognized as the same color when being irradiated with non-visible light in the first wavelength region, and emit light of a color visually recognized as the same color even when being irradiated with non-visible light in the second wavelength region, light-emission shapes as light-emitting forms are difference between irradiation with non-visible light in the first wavelength region (refer to FIG. 4) and irradiation with non-visible light in the second wavelength region (refer to FIG. 5). Accordingly, it is possible to perform discrimination with naked eyes on the basis of a difference in the light-emission shape.

In addition, in the forgery prevention medium 1 of the first embodiment, the fluorescent substance of the first light-emitting region 3 and the fluorescent substance of the second light-emitting region 4 emit light of colors visually recognized as different colors when being irradiated with non-visible light in the first wavelength region, and emit light of colors visually recognized as different colors even when being irradiated with non-visible light in the second wavelength region. According to this, coloring as a light-emitting form is different between irradiation with non-visible light in the first wavelength region (refer to FIG. 4) and irradiation with non-visible light in the second wavelength region (refer to FIG. 5). It is possible to perform discrimination with naked eyes on the basis of the difference in coloring.

Application Example of Forgery Prevention Medium 1

Figure 11:
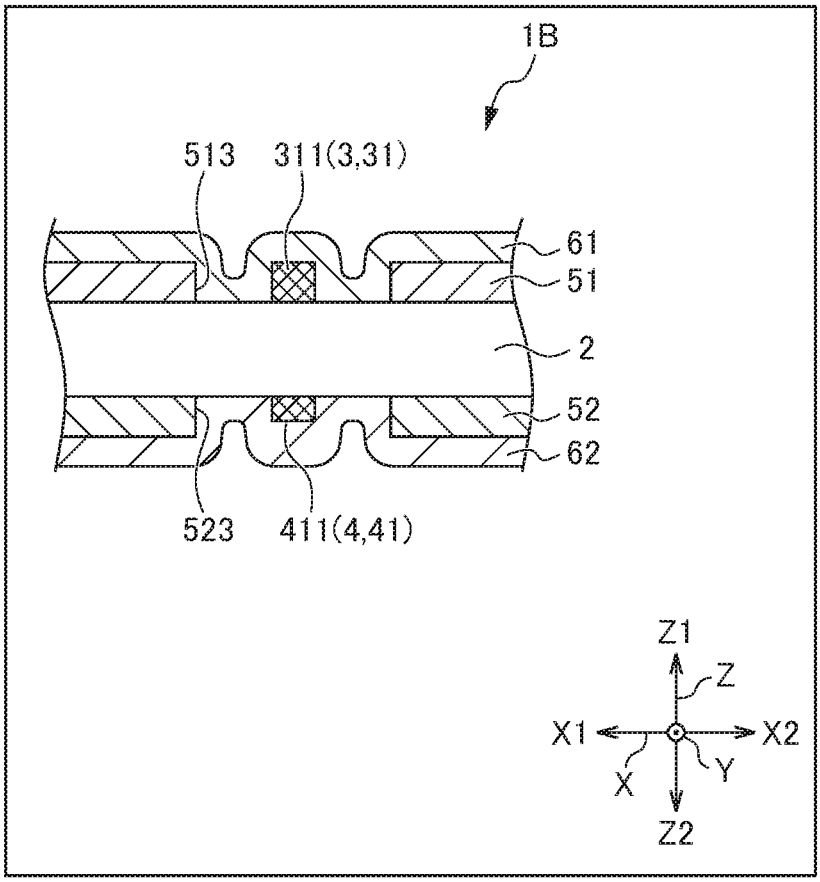
FIG. 11 is a view illustrating an example of a case where the forgery prevention medium 1 is set as plastic paper money 1B.
Figure 12:
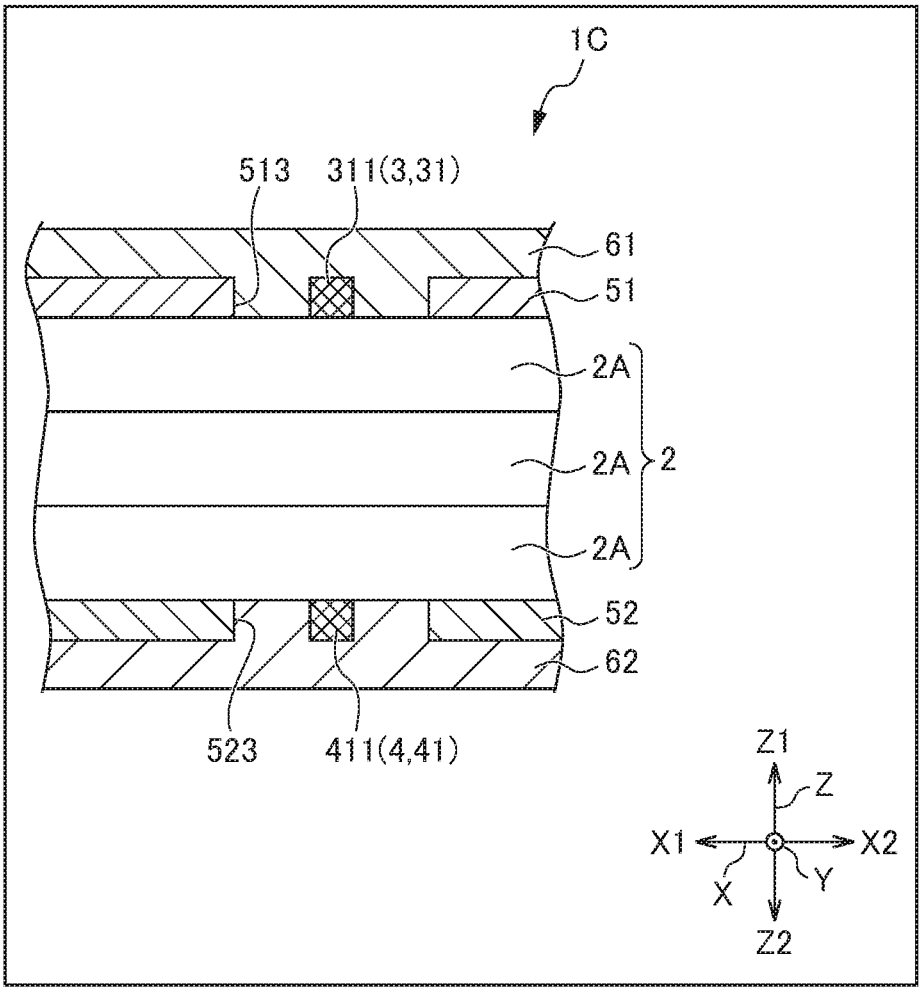
FIG. 12 is a view illustrating an example of a case where the forgery prevention medium 1 is set as a card 1C.
Figure 13:
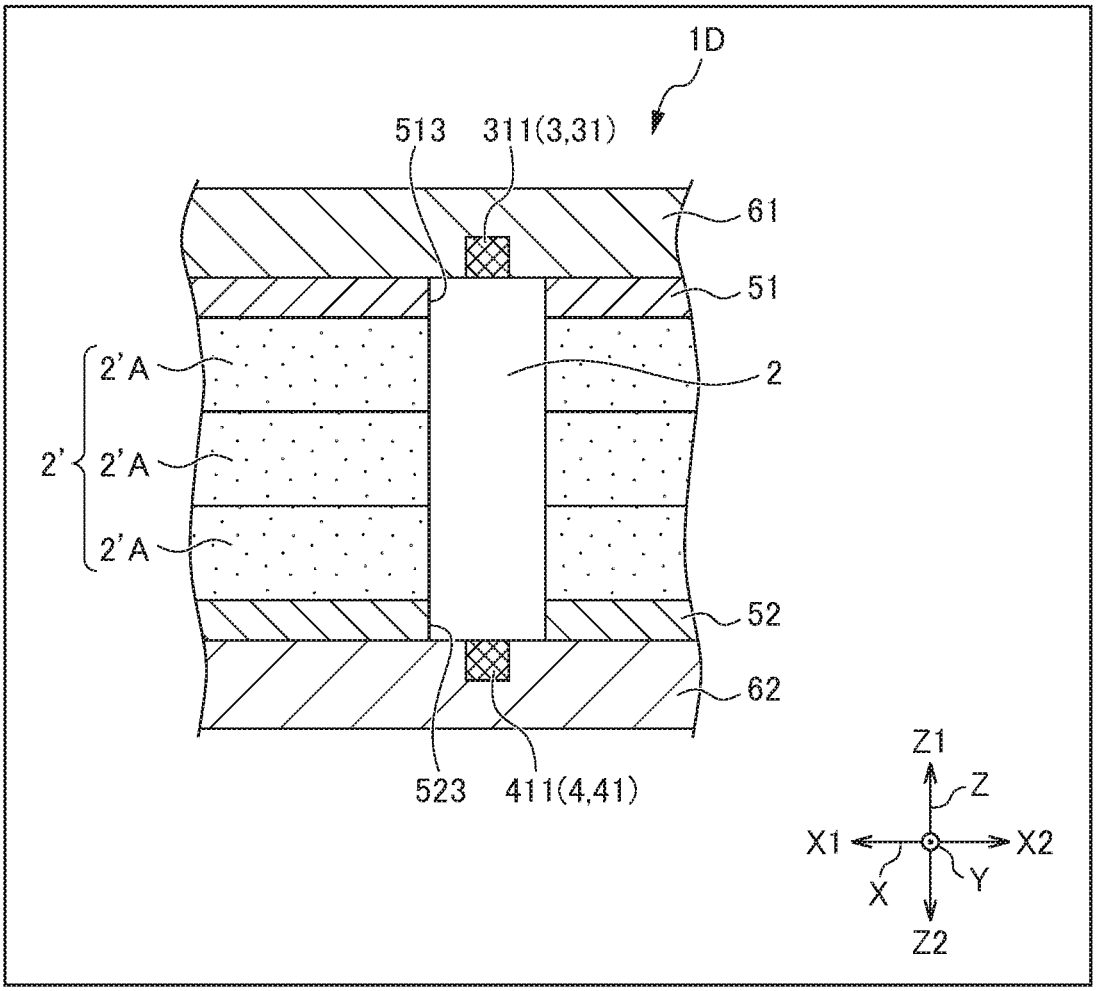
FIG. 13 is a view illustrating an example of a case where the forgery prevention medium 1 is set as data page 1D.

Next, an application example of the forgery prevention medium 1 will be described. FIG. 11 is a view illustrating an example of a case where the forgery prevention medium 1 is set as plastic paper money 1B. FIG. 12 is a view illustrating an example of a case where the forgery prevention medium 1 is set as a card 1C. FIG. 13 is a view illustrating an example of a case where the forgery prevention medium 1 is set as a data page 1D. Respective drawings of FIGS. 11 to 13 are enlarged views of the vicinity of the light-emitting region 3, 4 in a cross-sectional view that passes through the center of the light-emitting element 311, 411 of the forgery prevention medium 1 illustrated in FIG. 2(A) and is parallel to the XZ plane.

In a case where the forgery prevention medium 1 is set as the plastic paper money 1B, for example, as illustrated in FIG. 11, the transparent protective layer (61, 62) is formed by applying a transparent material (ink) to cover the printed layer (51, 52) and the light-emitting region (3, 4) formed in the window portion (513, 523) provided in the printed layer. According to this, in the window portion (513, 523), a portion other than the light-emitting element (31, 41) of the light-emitting region (3, 4) is filled with the transparent material that forms the transparent protective layer (61, 62). According to this, the light-emitting element (31, 41) on an inner side of the window portion (512, 513) is in a state of being covered with the transparent protective layer (61, 62) without a gap. In a case where the forgery prevention medium 1 is set as the plastic paper money 1B, for example, a polypropylene resin can be used in the substrate layer 2, and an acrylic resin can be used in the transparent protective layer (61, 62), but there is no limitation thereto.

In addition, in a case where the forgery prevention medium 1 is set as the card 1C such as a membership card, for example, as illustrated in FIG. 12, the transparent protective layer (61, 62) constituted by a transparent film material is disposed to cover the printed layer (51, 52) and the light-emitting region (3, 4) formed in the window portion (513, 523) provided in the printed layer. In this case, when the transparent film material is joined to the substrate layer 2 side through thermal compression, in the window portion (513, 523) provided in the printed layer (51, 52), a portion other than the light-emitting element (31, 41) of the light-emitting region (3, 4) is also filled with a melted transparent film material. According to this, on an inner side of the window portion (513, 523), the light-emitting element (31, 41) is in a state of being covered with the transparent protective layer (61, 62) without a gap. In a case where the forgery prevention medium 1 is set as the card 1C such as the membership card, for example, a polyethylene terephthalate resin can be used in the substrate layer 2 (substrate 2A), and a polyethylene terephthalate resin can be used in the transparent protective layer (61, 62), but there is no limitation thereto. Note that, the substrate layer 2 that constitutes the card 1C is not limited to one sheet of substrate, and a mode in which a plurality of substrates 2A (three sheets of substrates 2A in FIG. 12) are laminated may be employed in correspondence with the strength required for the card 1C or the like. In addition, in this case, the light-emitting elements (31, 41) may be disposed between the substrates 2A which are laminated. For example, the light-emitting element 31 may be disposed between the substrate 2A in a first layer and the substrate 2A in a second layer, and the light-emitting element 41 may be disposed between the substrate 2A in the second layer and the substrate 2A in a third layer. According to this, it is possible to further improve forgery prevention performance of the card 1C (forgery prevention medium 1). Note that, in this case, the plurality of substrates 2A are joined to each other through thermal compression, and the light-emitting element (31, 41) disposed between the substrates 2A is covered with the substrates 2A without a gap.

In addition, in a case where the forgery prevention medium 1 is set as the data page 1D such as a passport, for example, as illustrated in FIG. 13, the data page 1D has a mode in which the printed layer (51, 52) and the transparent protective layer (61, 62) are sequentially laminated on both surfaces of an opaque (for example, white or the like) substrate layer 2'. Here, the substrate layer 2 is provided at a position of the data page 1D at which the light-emitting region (3, 4) is provided. Specifically, when the data page 1D is viewed from the thickness direction (Z direction), the transparent substrate layer 2 is disposed at a position of the opaque substrate layer 2' which corresponds to the light-emitting region (3, 4), the window portion (513, 523) is provided at a position of the printed layer (51, 52) which corresponds to the light-emitting region (3, 4), and the substrate layer 2 is also disposed in the window portion. The light-emitting elements (31, 41) of the light-emitting regions (3, 4) are respectively provided on both surfaces (a surface on the Z1 side and a surface on the Z2 side) of the transparent substrate layer 2, and the transparent protective layer (61, 62) is provided to cover the opaque substrate layer 2', the transparent substrate layer 2, and the light-emitting element (31, 41). Here, as in the case of the above-described card 1C, the transparent protective layer (61, 62) is constituted by a transparent film material and is joined to the substrate layer side through thermal compression, and thus it enters a state in which the transparent protective layer (61, 62) covers the light-emitting element (31, 41) without a gap. In a case where the forgery prevention medium 1 is set as the data page 1D such as the passport, for example, a polycarbonate resin can be used in the substrate layer 2' (substrate 2'A), a polyethylene terephthalate resin can be used in the substrate layer 2, and a polycarbonate resin can be used in the transparent protective layer (61, 62), but there is no limitation thereto. Note that, the opaque substrate layer 2' that constitutes the data page 1D is not limited to one sheet of substrate, and a mode in which a plurality of substrates 2'A (three sheets of substrates 2'A in FIG. 13) are laminated in correspondence with strength required for the data page 1D or the like may be employed. In addition, the substrate layer 2 of the data page 1D is not limited to one sheet of substrate, and a mode in which a plurality of substrates 2A (for example, three sheets of substrates 2A) are laminated in correspondence with strength required for the data page 1D or the like may be employed as in the substrate layer 2'. In this case, the light-emitting element (31, 41) may be disposed between the substrates 2A which are laminated. For example, the light-emitting element 31 may be disposed between the substrate 2A in a first layer and the substrate 2A in a second layer, and the light-emitting element 41 may be disposed between the substrate 2A in the second layer and the substrate 2A in a third layer. According to this, it is possible to further improve the forgery prevention performance of the data page 1D (forgery prevention medium 1). Note that, in this case, the plurality of substrates 2A are joined to each other through thermal compression, and the light-emitting element (31, 41) disposed between the substrates 2A is covered with the substrates 2A without a gap.

Second Embodiment

Figure 6:
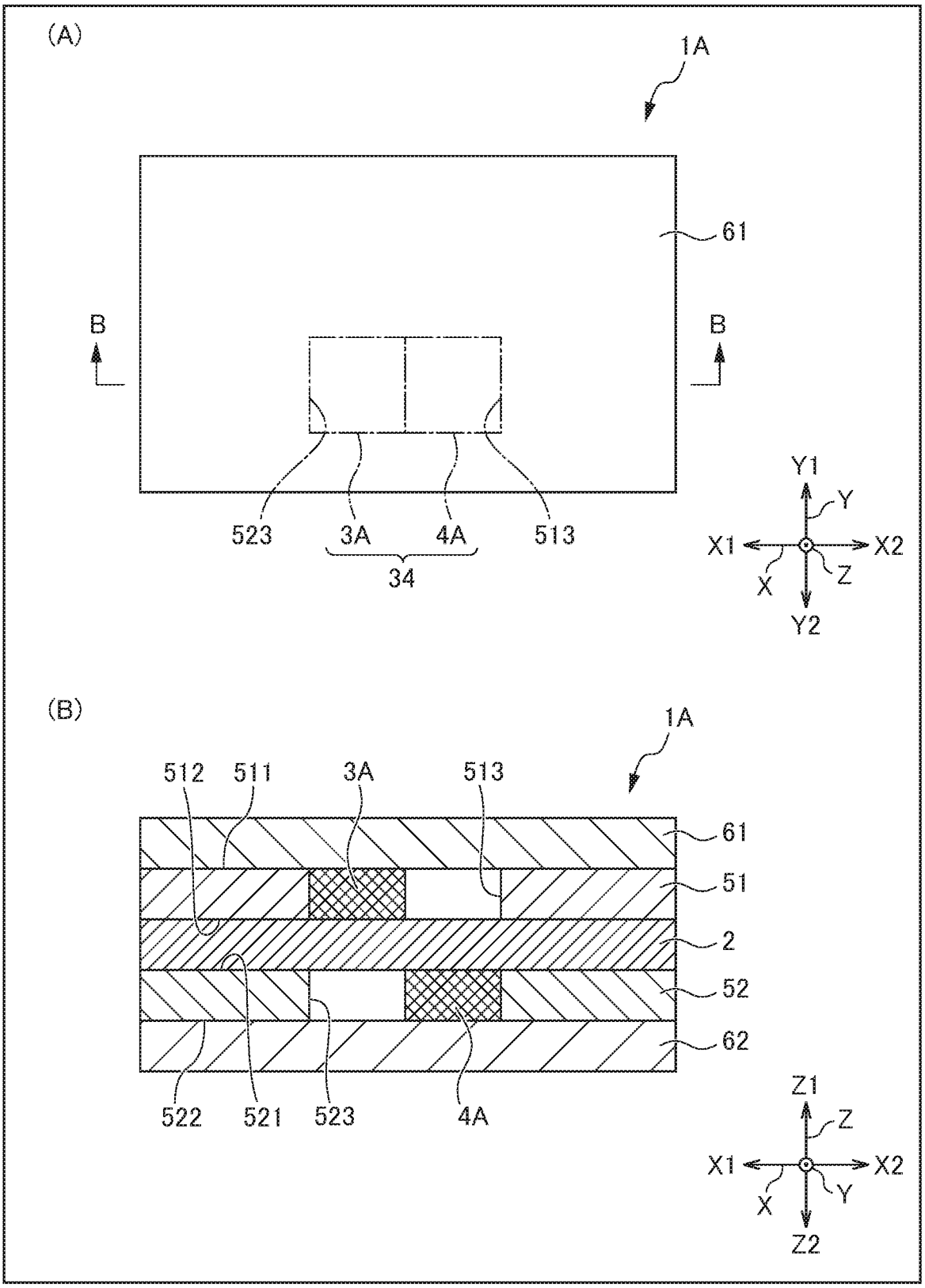
FIG. 6 is a view illustrating a forgery prevention medium 1A of a second embodiment as the light-emitting medium of the invention, and in FIG. 6, (A) is a plan view, and (B) is a cross-sectional view taken along line B-B in (A).
Figure 7:
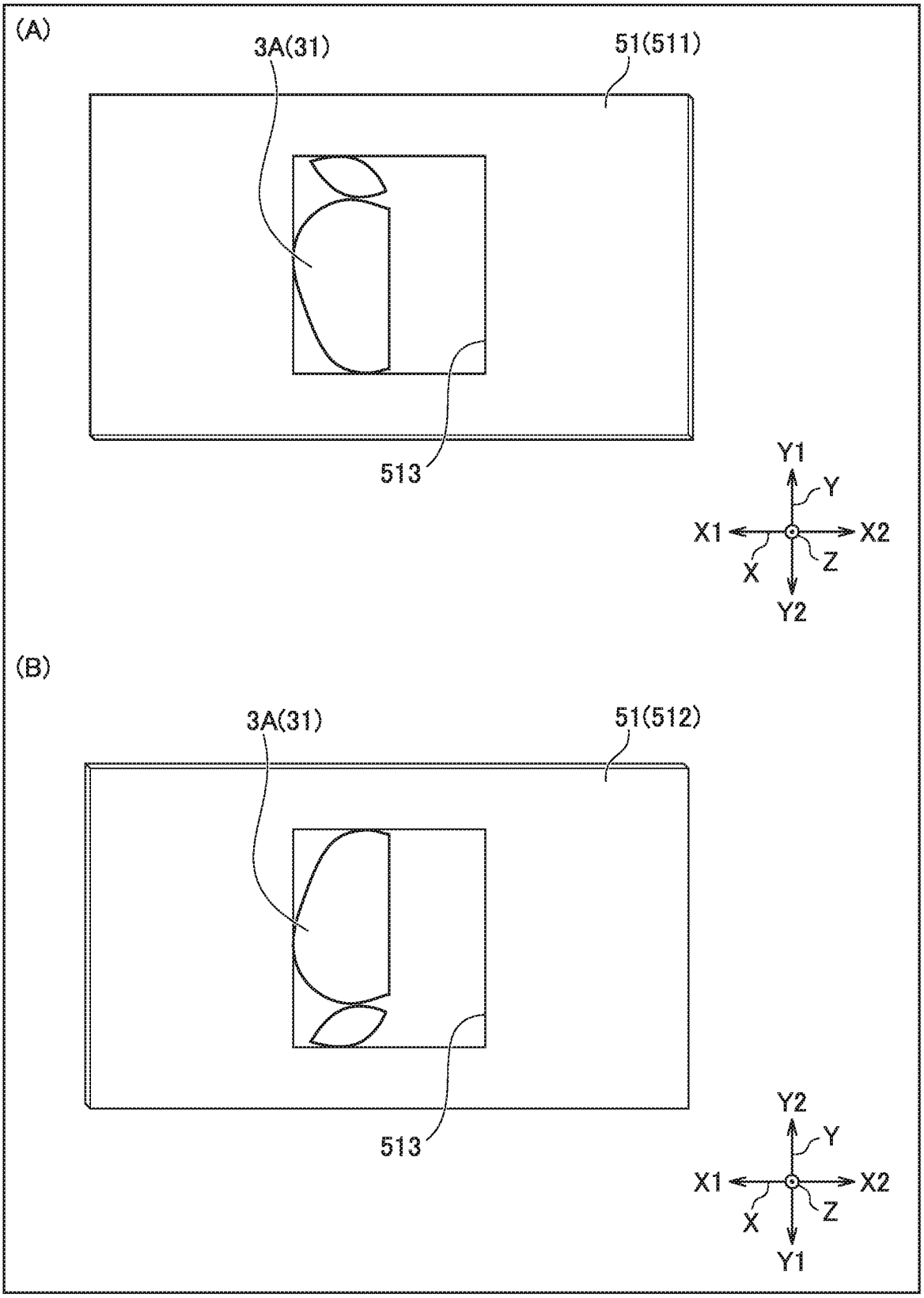
FIG. 7 is a view illustrating a first printed layer 51 including a first light-emitting region 3A in the forgery prevention medium 1A of the second embodiment by virtually extracting the first printed layer 51, and in FIG. 7, (A) is a plan view, and (B) is a rear view.
Figure 8:
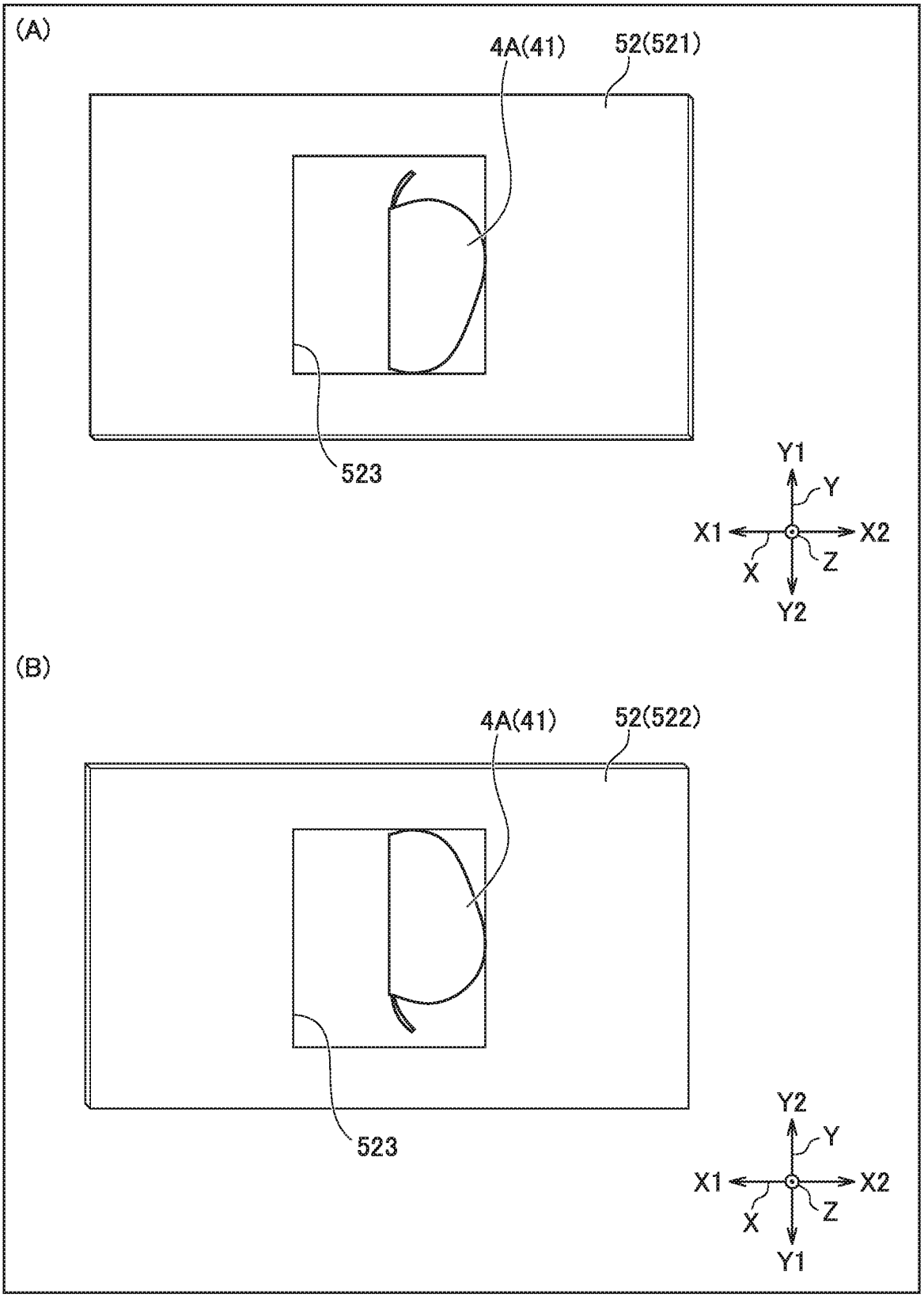
FIG. 8 is a view illustrating a second printed layer 52 including a second light-emitting region 4A in the forgery prevention medium 1A of the second embodiment by virtually extracting the second printed layer 52, and in FIG. 8, (A) is a plan view, and (B) is a rear view.
Figure 9:
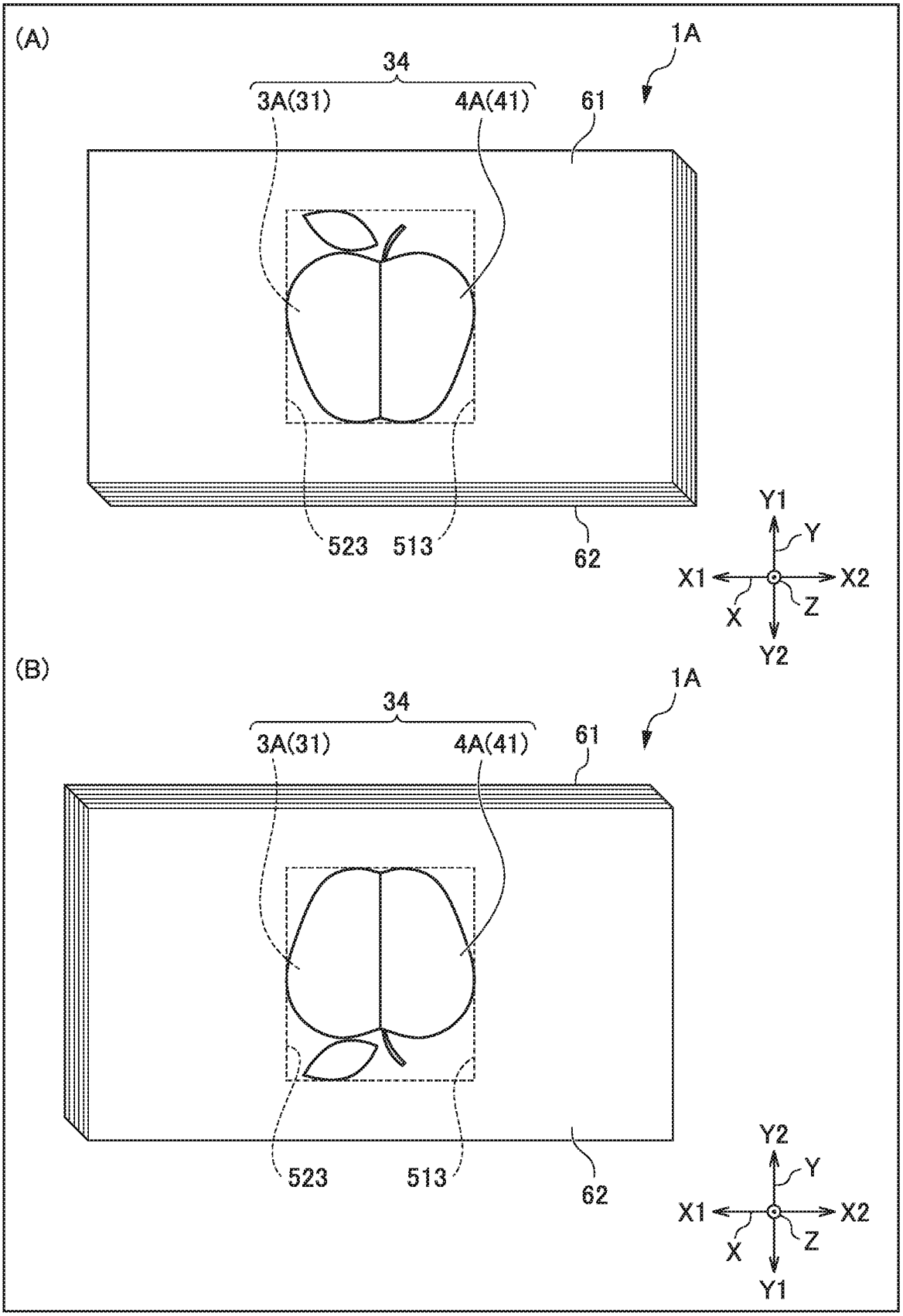
FIG. 9 is a view illustrating a light-emitting form when the forgery prevention medium 1 of the first embodiment is irradiated with non-visible light in the first wavelength region, and in FIG. 9, (A) is a plan view, and (B) is a rear view.
Figure 10:
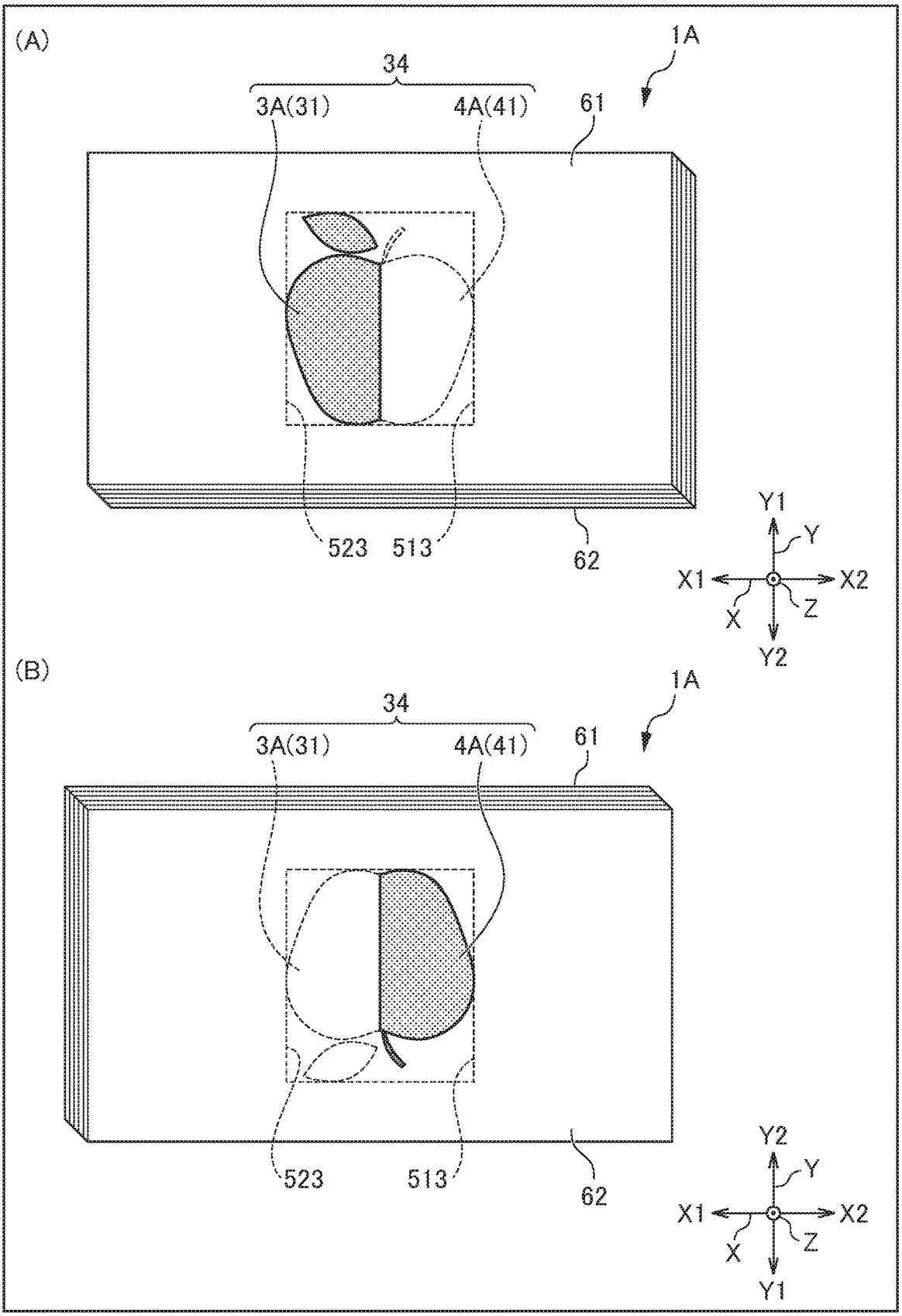
FIG. 10 is a view illustrating a light-emitting form when the forgery prevention medium 1 of the first embodiment is irradiated with non-visible light in the second wavelength region, and in FIG. 10, (A) is a plan view, and (B) is a rear view.

Next, a second embodiment of the invention will be described. Note that, in the following description and drawings, the same reference numeral or digit will be appropriately given to a portion having the same function as in the first embodiment, and redundant description will be appropriately omitted. FIG. 6 is a view illustrating a forgery prevention medium 1A of the second embodiment as the light-emitting medium of the invention, and in FIG. 6, (A) is a plan view, and (B) is a cross-sectional view taken along line B-B in (A). FIG. 7 is a view illustrating a first printed layer 51 including a first light-emitting region 3A in the forgery prevention medium 1A of the second embodiment by virtually extracting the first printed layer 51, and in FIG. 7, (A) is a plan view, and (B) is a rear view. FIG. 8 is a view illustrating a second printed layer 52 including a second light-emitting region 4A in the forgery prevention medium 1A of the second embodiment by virtually extracting the second printed layer 52, and in FIG. 8, (A) is a plan view, and (B) is a rear view. FIG. 9 is a view illustrating a light-emitting form when the forgery prevention medium 1A of the second embodiment is irradiated with non-visible light in the first wavelength region, and in FIG. 9, (A) is a plan view, and (B) is a rear view. FIG. 10 is a view illustrating a light-emitting form when the forgery prevention medium 1A of the second embodiment is irradiated with non-visible light in the second wavelength region, and in FIG. 10, (A) is a plan view, and (B) is a rear view.

In the first embodiment, the first light-emitting region 3 and the second light-emitting region 4 have shapes which partially do not overlap each other (shapes which partially overlap each other) when viewed in the thickness direction Z of the substrate 2 through the substrate 2. In contrast, in the second embodiment, the first light-emitting region 3A and the second light-emitting region 4A have shapes which completely do not overlap each other when viewed in the thickness direction Z of the substrate 2 through the substrate 2.

In addition, in the second embodiment, the first light-emitting region 3A and the second light-emitting region 4A show an incomplete shape only on one side. In a state in which both the fluorescent substance of the first light-emitting region 3A and the fluorescent substance of the second light-emitting region 4A emit light, the first light-emitting region 3A and the second light-emitting region 4A show a complete shape on both sides. Note that, the second embodiment is an embodiment in which the completeness/incompleteness of light-emission shape is clear, but it can be understood that the first embodiment also has completeness/incompleteness of the light-emission shape. Since a window portion provided in each of printed layers is a region in which printing is not performed to a part of the printed layer, that is, a region through which incident light can be transmitted, as in the forgery prevention medium 1 of the above-described first embodiment, the window portion may be filled with a transparent material of a polycarbonate resin or the like, or a transparent member of the same resin or the like may be disposed in the window portion in accordance with an application mode. That is, the periphery of light-emitting elements (31, 41) provided in a window portion (513, 523) is covered with the transparent material or the like (transparent protective layer) without a gap.

The first light-emitting region 3A and the second light-emitting region 4A have shapes which completely do not overlap each other when viewed in the thickness direction Z of the substrate layer 2 through the substrate layer 2. Specifically, a first light-emitting element 31 of the first light-emitting region 3A has a shape of the left half of an apple being fruit. A second light-emitting element 41 of the second light-emitting region 4A has a shape of the right half of the apple. When viewed in the thickness direction Z of the substrate layer 2 through the substrate layer 2, the first light-emitting element 31 having the shape of the left half of the apple, and the second light-emitting element 41 having the shape of the right half of the apple are adjacent to each other. Note that, "adjacent to each other" is widely interpreted, and an opposing edge in the first light-emitting element 31 and an opposing edge in the second light-emitting element 41 may match each other, may be slightly spaced away from each other, or may slightly overlap each other. In addition, the opposing edge in the first light-emitting element 31 and the opposing edge in the second light-emitting element 41 may be greatly spaced away from each other without being adjacent to each other.

The fluorescent substance of the first light-emitting region 3A and the fluorescent substance of the second light-emitting region 4A emit light of a color visually recognized as the same color when being irradiated with non-visible light in the first wavelength region, and emit light of color visually recognized as the same color when being irradiated with non-visible light in the second wavelength region. Note that, as in the first embodiment, the fluorescent substance of the first light-emitting region 3A and the fluorescent substance of the second light-emitting region 4A may emit light of colors visually recognized as different colors when being irradiated with non-visible light in the first wavelength region, and may emit light of colors visually recognized as different colors even when being irradiated with non-visible light in the second wavelength region.

Light-Emitting Form in Irradiation with Non-Visible Light in First Wavelength Region Description will be given of a light-emitting form in irradiation with non-visible light in the first wavelength region. At the time of irradiation with non-visible light in the first wavelength region, non-visible light in the first wavelength region is transmitted through the transparent protective layer and the window portion, and is transmitted through the substrate layer 2. Accordingly, when being irradiated with non-visible light in the first wavelength region, a light-emitting region located on an irradiation source side emits light, and a light-emitting region located on a side opposite to the irradiation source with the substrate layer 2 interposed therebetween also emits light. That is, as illustrated in FIG. 9, both the first light-emitting region 3A and the second light-emitting region 4A emit light. Note that, in FIG. 9, the first light-emitting region 3A and the second light-emitting region 4A do not exist in an outermost layer, but are indicated by a solid line for convenience. When both the first light-emitting region 3A having the shape (incomplete shape) of the left half of the apple, and the second light-emitting region 4A having the shape (incomplete shape) of the right half of the apple emit light, a complete light-emission shape 34 showing the apple having a complete shape is formed (emits light and is visually recognized).

Light-Emitting Form in Irradiation with Non-Visible Light in Second Wavelength Region Description will be given of a light-emitting form in irradiation with non-visible light in the second wavelength region. At the time of irradiation with non-visible light in the second wavelength region, non-visible light in the second wavelength region is transmitted through the transparent protective layer and the window portion, but is not transmitted through the substrate layer 2. Accordingly, when being irradiated with non-visible light in the second wavelength region, a light-emitting region located on an irradiation source side emits light, but a light-emitting region located on a side opposite to the irradiation source with the substrate layer 2 interposed therebetween does not emit light. That is, as illustrated in FIG. 10(A), when being irradiated with non-visible light in the second wavelength region from the first light-emitting region 3A (first transparent protective layer 61) side, the first light-emitting region 3A emits light, but the second light-emitting region 4A located on an opposite side with the substrate layer 2 interposed therebetween does not emit light. Note that, in FIG. 10(A), the first light-emitting region 3A does not exist in an outermost layer, but is indicated by a solid line for convenience, and light-emission is indicated by dot hatching.

On the other hand, as illustrated in FIG. 10(B), when being irradiated with non-visible light from the second light-emitting region 4A (second transparent protective layer 62) side, the second light-emitting region 4A emits light, but the first light-emitting region 3A located on an opposite side with the substrate layer 2 interposed therebetween does not emit light. Note that, in FIG. 10(B), the second light-emitting region 4A does not exist in an outermost layer, but is indicated by a solid line for convenience, and light-emission is indicated by dot hatching.

Effect of Second Embodiment

According to the forgery prevention medium 1A of the second embodiment, for example, the following effect is obtained. In the forgery prevention medium 1A of the second embodiment, the first light-emitting region 3A and the second light-emitting region 4A show an incomplete shape only on one side (refer to FIG. 10). In addition, in a state in which both the fluorescent substance of the first light-emitting region 3A and the fluorescent substance of the second light-emitting region 4A emit light, the first light-emitting region 3A and the second light-emitting region 4A show a complete shape on both sides (refer to FIG. 9).

Accordingly, in irradiation with non-visible light in the first wavelength region (refer to FIG. 9), light is emitted in a complete light-emission shape (complete apple), and on the other hand, in irradiation with non-visible light in the second wavelength region (refer to FIG. 10), light is emitted in an incomplete light-emission shape (the half of the apple).

According to this, it is possible to conceptually easily discriminate both light-emission forms.

Hereinbefore, embodiments of the invention have been described. However, the invention is not limited to the above-described embodiments, various modifications and changes to be exemplified later can be made, for example, and the modifications or changes are also included in the technical range of the invention. In addition, the effects described in the embodiments are exemplified as the most preferred effects obtained by the invention, and the effect of the invention is not limited to the effects described in the embodiments. Note that, the above-described embodiments and modification examples can be used in appropriate combination, but detailed description thereof will be omitted.

In the XY plane, the first light-emitting region 3 and the second light-emitting region 4 respectively constitute a part of the first printed layer 51 and the second printed layer 52, but there is no limitation thereto. The first light-emitting region 3 and the second light-emitting region 4 may be provided in a whole surface in the XY plane. A layer formed through (application and the like) other than printing may be employed instead of the first printed layer 51 and the second printed layer 52.

The light-emitting medium of the invention may be provided with a layer that is not provided in the above-described embodiments, and may not be provided with a layer that is provided in the embodiments but is not essential in an opposite manner. The light-emitting medium of the invention is applicable to various media which use a variation, unexpectedness, or the like in the light-emission form without limitation to the forgery prevention medium. The shape of the light-emitting medium may be a plate shape or a block shape without limitation to the sheet shape. Discrimination of the sheet shape, the plate shape, and the block shape is made on relative and technical basis on the basis of a ratio of thickness or the like.

EXPLANATION OF REFERENCE NUMERALS

1, 1A LIGHT-EMITTING MEDIUM (FORGERY PREVENTION MEDIUM)
2 SUBSTRATE LAYER (SUBSTRATE)
3, 3A FIRST LIGHT-EMITTING REGION
4, 4A SECOND LIGHT-EMITTING REGION
Z THICKNESS DIRECTION

The invention claimed is:

1. A light-emitting medium comprising a substrate, a first light-emitting region, and a second light-emitting region, wherein the first light-emitting region is disposed on a first side of the substrate and the second light-emitting region is disposed on a second side of the substrate, wherein the substrate includes a selective transmission layer through which non-visible light in a first wavelength region is transmitted, non-visible light in a second wavelength region different from the first wavelength region is not substantially transmitted, and visible light emitted from a fluorescent substance is transmitted, and the first light-emitting region and the second light-emitting region contain the fluorescent substance that emits visible light when being irradiated with non-visible light in the first wavelength region and also emits visible light when being irradiated with non-visible light in the second wavelength region.

2. The light-emitting medium according to claim 1, wherein the first light-emitting region and the second light-emitting region have shapes which at least partially do not overlap each other when viewed in a thickness direction of the substrate through the substrate.

3. The light-emitting medium according to claim 1, wherein the fluorescent substance of the first light-emitting region and the fluorescent substance of the second light-emitting region emit light having different colors when being irradiated with non-visible light in the first wavelength region, and emit light having different colors even when being irradiated with non-visible light in the second wavelength region.

4. The light-emitting medium according to claim 1, wherein when the light-emitting medium is irradiated with non-visible light in the second wavelength region on the first side of the substrate, only the first light-emitting region emits light, and shows an incomplete shape; and when the light-emitting medium is irradiated with non-visible light in the second wavelength region on the second side of the substrate, only the second light-emitting region emits light, and shows, and wherein when the light-emitting medium is irradiated with non-visible light in the first wavelength region on either the first side of the substrate or the second side of the substrate, both the first light-emitting region and the second light-emitting region emit light and show a complete shape.

5. A forgery prevention medium to which the light-emitting medium according to claim 1 is applied.

6. A method for determining authenticity of a light-emitting medium, wherein the light-emitting medium comprises a substrate, a first light-emitting region, and a second light-emitting region, wherein the first light-emitting region is disposed on a first side of the substrate and the second light-emitting region is disposed on a second side of the substrate, wherein the substrate includes a selective transmission layer through which non-visible light in a first wavelength region is transmitted, and non-visible light in a second wavelength region different from the first wavelength region is not substantially transmitted, and the first light-emitting region and the second light-emitting region contain a fluorescent substance that emits light when being irradiated with non-visible light in the first wavelength region and also emits light when being irradiated with non-visible light in the second wavelength region;

the method comprising:

a preparation process of preparing a light-emitting medium;

a first wavelength irradiation process of irradiating the light-emitting medium with non-visible light in a first wavelength region to confirm light-emission of both of the fluorescent substance of the first light-emitting region and the fluorescent substance of the second light-emitting region;

a second wavelength irradiation process of irradiating the light-emitting medium with non-visible light in a second wavelength region to confirm light-emission of either the fluorescent substance of the first light-emitting region or the fluorescent substance of the second light-emitting region; and a determination process of determining that the light-emitting medium is genuine when confirmation is obtained in both the first wavelength irradiation process and the second wavelength irradiation process.

* * * * *